United States Patent [19]

Fushiya et al.

[11] Patent Number: 4,462,381

[45] Date of Patent: Jul. 31, 1984

[54] POWER CUTTING TOOL

[75] Inventors: Fusao Fushiya; Nobuhiro Inoue, both of Anjo, Japan

[73] Assignee: Makita Electric Works, Ltd., Aichi, Japan

[21] Appl. No.: 368,836

[22] Filed: Apr. 15, 1982

[30] Foreign Application Priority Data

May 1, 1981 [JP] Japan ..... 56-64849[U]
Jul. 28, 1981 [JP] Japan ..... 56-112717[U]
Jul. 29, 1981 [JP] Japan ..... 56-113153[U]

[51] Int. Cl.[3] ..... B28D 1/18

[52] U.S. Cl. ..... 125/4; 51/170 T; 51/268; 51/273

[58] Field of Search ..... 51/170 T, 177, 268, 51/176, 273; 125/3, 4

[56] References Cited

U.S. PATENT DOCUMENTS

| | | | |
|---|---|---|---|
| 1,303,643 | 5/1919 | Engel | 51/176 |
| 1,404,342 | 1/1922 | Clarke | 51/176 |
| 1,770,549 | 7/1930 | Peterson | 51/170 T |
| 2,069.700 | 2/1937 | Emmons | 51/176 |
| 2,077,195 | 4/1937 | Adams | 51/128 |
| 2,143,970 | 1/1939 | Blood | 51/170 T |
| 2,204,178 | 6/1940 | Gartner | 51/177 |
| 2,301.164 | 11/1942 | Mall | 51/177 |
| 2,640,211 | 6/1953 | Peterson | 51/177 |
| 3,334,448 | 8/1967 | Alexander | 51/170 T |
| 3,594,958 | 7/1971 | Cusumano | 51/170 T |
| 3,862,521 | 1/1975 | Isaksson | 51/170 T |
| 4,287,685 | 9/1981 | Marton | 51/170 T |

*Primary Examiner*—Harold D. Whitehead

*Attorney, Agent, or Firm*—Dennison, Meserole, Pollack & Scheiner

[57] ABSTRACT

A power cutting tool having a body, a base for supporting the body, and a housing provided at the front end of the body, comprises a substantially saucer-shaped rotary cutter rotatably supported within and by the housing and having a cutting face substantially on the same level as the bottom of the base; a guide roller disposed in front of the housing and adapted to roll on a workpiece surface, which guide roller being vertically movable with respect to said body so as to control the depth of cut of the rotary cutter; a movable cover fitted to the lowermost end of the housing and adapted to annularly enclose the rotary cutter and to cover the workpiece surface so as to define a cutting chamber which in turn is defined into an inside chamber and an outside chamber by the rotary cutter; and a plurality of communicating ports provided on the rotary cutter and adapted to communicate the inside chamber and the outside chamber therethrough.

9 Claims, 8 Drawing Figures

POWER CUTTING TOOL

BACKGROUND OF THE INVENTION

This invention relates to a cutting tool and particularly a power cutting tool adapted to cut concrete surfaces and the like.

According to the invention, a power cutting tool having a body, a base for supporting the body, and a housing provided at the front end of the body, comprises a substantially saucer-shaped rotary cutter rotatably supported within and by the housing and having a cutting face substantially on the same level as the bottom of the base; a guide roller disposed in front of the housing and adapted to roll on a workpiece surface, which guide roller being vertically movable with respect to said body so as to control the depth of cut of the rotary cutter; a movable cover fitted to the lowermost end of the housing and adapted to annularly enclose the rotary cutter and to cover the workpiece surface so as to define a cutting chamber which in turn is defined into an inside chamber and an outside chamber by the rotary cutter; and a plurality of communicating ports provided on the rotary cutter and adapted to communicate the inside chamber and the outside chamber therethrough.

It is the principal object of the invention to provide a power cutting tool which permits ready depth of cut adjustment by simple manipulation to facilitate a smooth cutting operation.

It is another object of the invention to provide a power cutting tool which covers a workpiece surface in a tightly sealed condition in opposition to the change of the cutting plane of the rotary cutter at all times while cutting proceeds.

It is a further object of the invention to provide a power cutting tool having means which prevents cutting chips from scattering and discharges them away.

The invention will become more fully apparent from the claims and the description as it proceeds in connection with the drawings.

DETAILED DESCRIPTION OF THE PREFERRED EMBODIMENT

Figure 1:
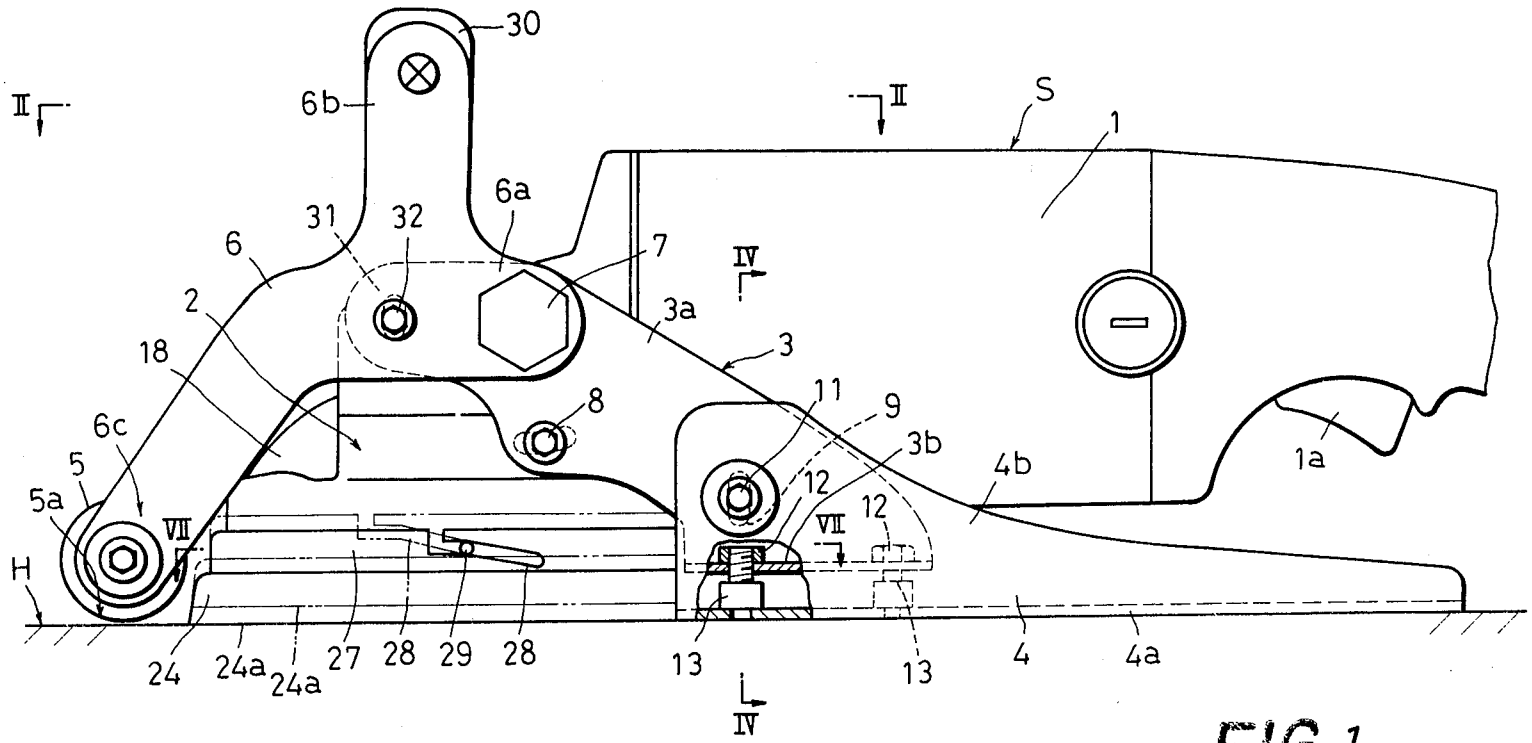
FIG. 1 is a side elevational view of a power cutting tool according to this invention.
Figure 2:
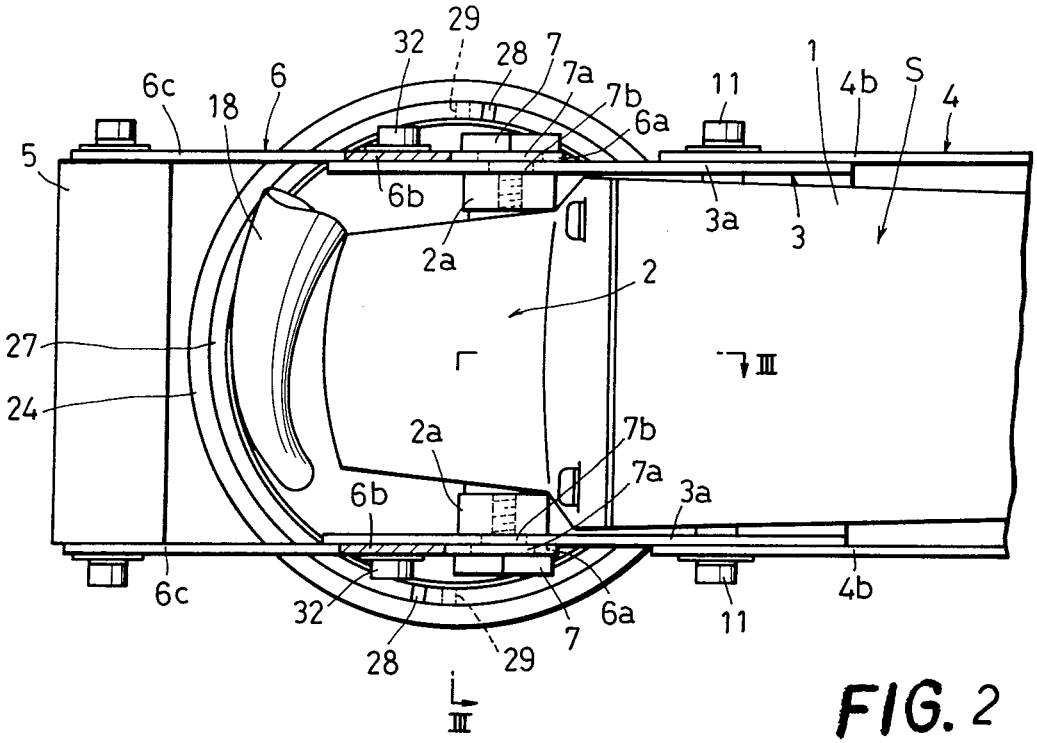
FIG. 2 is a view looking in the direction of arrow II—II of FIG. 1.
Figure 3:
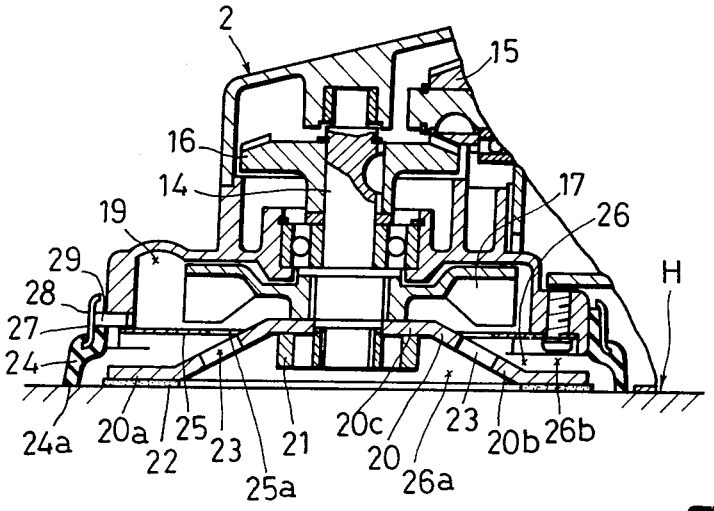
FIG. 3 is a sectional view taken along line III—III of FIG. 2.
Figure 4:
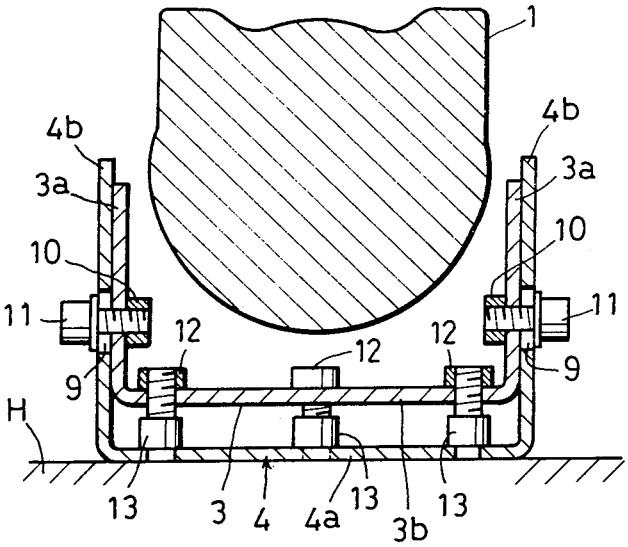
FIG. 4 is a sectional view taken along line IV—IV of FIG. 1.
Figure 7:
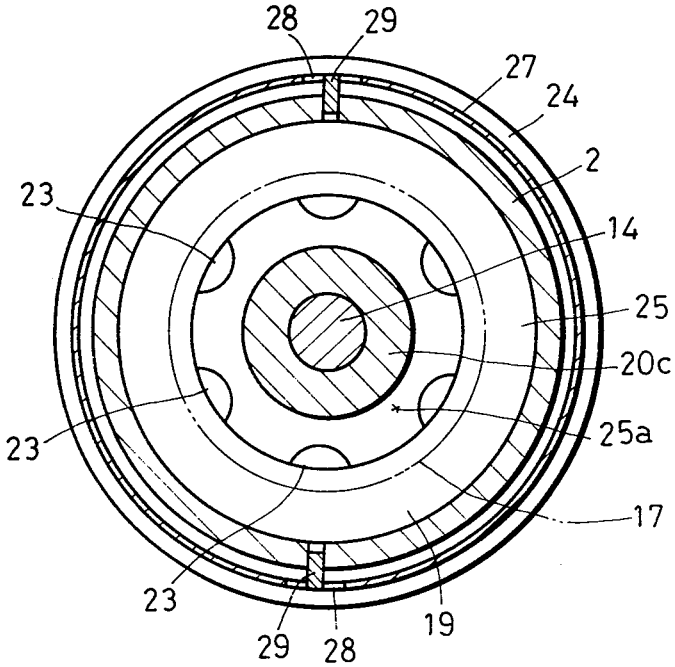
FIG. 7 is a sectional view taken along line VII—VII of FIG. 1.
Figure 5:
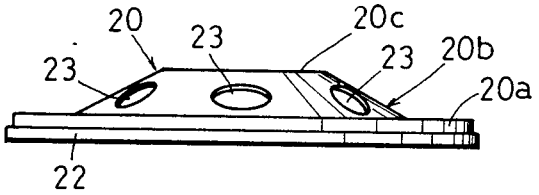
FIG. 5 is a side elevational view of the cutter.
Figure 6:
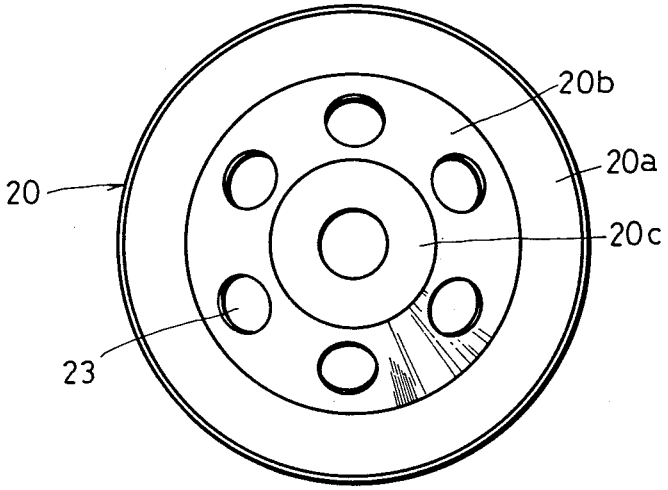
FIG. 6 is a top plan view thereof.

Referring now in detail to the drawings, in FIG. 1 there is shown a power cutting tool body S which comprises drive means 1 encasing drive mechanism of an electric motor and others and a housing 2 connected to the forward end of the drive means 1 and encasing cutting means and others. An operating lever 1*a* is provided to control the rotation of the electric motor. The tool body S is also connected at the forward end thereof to a base holder 3 which is connected to a base 4. The base 4 contacts with the workpiece surface H, supporting the tool body S. A pair of roller holders 6 carrying a guide roller 5 elongate toward the front of the base 4.

The base holder 3 is a member having a U-shaped section and surrounding the lower portion of the forward end of the drive means 1. The base holder 3 has opposite wall portions 3*a* upwardly tilting toward the front. The housing 2 has boss portions 2*a* at the opposite upper wall portions, and a stepped support bolt 7 is threadably engaged with each of the boss portions 2*a*. The forward ends of the opposite wall portions 3*a* are fitted in tiltingly movable condition to the lower step portions 7*b* of the stepped support bolts 7 to hold the housing 2 tightly therebetween. Adjusting bolts 8 are provided below the support bolts 7 to adjust the tilting movement of the opposite wall portions 3*a* with respect to the opposite wall portions of the housing 2 and then to fix them thereon.

The base 4 is a member having a U-shaped section and surrounding the lower portion of the forward end of the drive means 1 and the bottom portion 3*b* of the base holder 3. The base 4 has a bottom 4*a* and opposite wall portions 4*b*. The lower surface of the bottom 4*a* forms a guide surface which contacts with the workpiece surface H. The upper edges of the opposite wall portions 4*b* form easy slopes slanting down to the backward. Each of the opposite wall portions 4*b* has a vertically elongated slide hole 9 in the vicinity of the forward end thereof. A nut 10 is fixed on the inside surface of each wall portion 3*a* of the base holder 3 at a position opposite to the slide hole 9. An adjusting bolt 11 extends through the slide hole 9 and is threadably engaged with the nut 9 to adjust the vertical movement of the base 4 with respect to the rearmost end of the base holder 3 and then fix it thereto. Nuts 12 are fixed on the upper surface of the bottom 3*b* of the base holder 3 and threadably engaged with bolts 13 to adjust the slight vertical movement of the base 4 with respect to the base holder 3 and then fix it thereto.

Cutting means encased in the housing 2 comprises a spindle 14 vertically extending in the center of the housing 2 and rotatably supported by the housing 2. A driven bevel gear 16 is fitted to the top end of the spindle 14 and horizontally rotates in engagement with a drive bevel gear 15 provided at the forward end of the drive means 1. Below the driven bevel gear 16 is a fan 17 mounted on the spindle 14 with a spaced relationship in the vicinity of the lower end of the housing 2. The fan 17 rotates within a fan chamber 19 to induce suction air flow which will serve to blow away cutting chips through an exhaust duct 18 connected to the fan chamber 19 into a duct sack not shown.

A rotary cutter 20 is a substantially saucer-shaped member inserted upside down onto the lower end of the spindle 14 and fixed thereto by a lock nut 21. The rotary cutter 20 has a lowermost end 20*a* which is horizontally formed facing to the workpiece surface H through an annular tip 22 fixed on the lower surface of the lowermost end 20*a*. The slanting peripheral portion 20*b* of the rotary cutter 20 has a plurality of communicating ports 23 (six ports in this embodiment) planetarily positioned so as to keep the rotational balance of the rotary cutter 20.

The rotary cutter 20 is surrounded by a cover body 24 which is rotatably fitted onto the lowermost end of the housing 2. The cover body 24 is a substantially hollow cylindrical member made of a resilient material like natural rubber in this embodiment. The fan chamber 19 is confined by a separator 25 spreading in the vicinity of the lowermost end of the housing 2. The separator 25 has in the center thereof a dust port 25*a* through which the base portion 20*c* of the cutter 20 is inserted. The separator 25 defines within the cover body 24 a cutting chamber 26 which, when the opening lower edge 24*a* of the cover body 24 is contacted annularly tightly with the workpiece surface H, covers the workpiece surface H in a sealed condition and is divided into an inside chamber 26*a* defined inside of the rotary cutter 20 and an outside chamber 26*b* defined outside thereof.

There is provided a retaining ring 27 firmly fitted onto the outside periphery of the uppermost edge of the cover body 24. The retaining ring 27 has a pair of slits 28 symmetrically disposed in the upper portion thereof. The slits 28 are opened at the upper end thereof and then tilt downwardly. The housing 2 has at the lowermost end thereof a pair of engaging pins 29 slightly projecting transversely in opposition to the slits 28 so as to engage with them. Thus, the slits 28 are tiltingly slidable in engagement with the engaging pins 29 to move the retaining ring 27 and resultantly the cover body 24 vertically with respect to the housing 2. When cutting is carried out, the housing 2 is pressed downwardly to contact the tip 22 of the rotary cutter 20 with the workpiece surface H and the retaining ring 27 is rotated under the guidance of the engaging pins 29 to move the opening lower edge 24*a* of the cover body 24 vertically in relation to the cutting plane of the rotary cutter 20. Then, the opening lower edge 24*a* can be tightly pressed against the workpiece surface H to confine the cutting chamber 26 in a sealed condition.

A pair of roll holders 6 carrying a guide roller 5 therebetween are connected to the opposite wall portions of the housing 2, and swingably fitted at their rearmost ends 6*a* to the upper step portions 7*a* of the support bolts 7. The roll holders 6 branch upwardly at a position slightly in front of the rearmost ends 6*a* to form a pair of projections 6*b* which carry a transversely extending grip 30 therebetween at the upper ends thereof. Each of the roll holders 6 has a front end 6*c* extending in front of the housing 2 and having in the central portion thereof a vertically elongated adjusting hole 31 through which a machine screw 32 extends to adjust the swinging angle of the roll holder 6 with respect to the base holder 3 and then fix it thereto at the front end of the wall portion 3*a* thereof.

The guide roller 5 is rotatably held between the front ends 6*c* of the opposite roll holders 6. Adjustment of the swinging angle of the roll holder 6 causes change of the elevational space between the lowermost edge 5*a* of the guide roller 5 and the cutting plane of the rotary cutter 20, resulting in adjustment of the depth of cut of the rotary cutter 20.

In operation, the guide roller 5 is swung to a desired position by means of the machine screw 32 through the roller holder 6 to determine the elevational positioning thereof in relation to the rotary cutter 20. Now, the depth of cut or the amount of cut by the rotary cutter 20 can be adjusted, as the elevational difference between the lowermost surface of the guide roller 5 and that of the rotary cutter 20 is thus determined.

Figure 8:
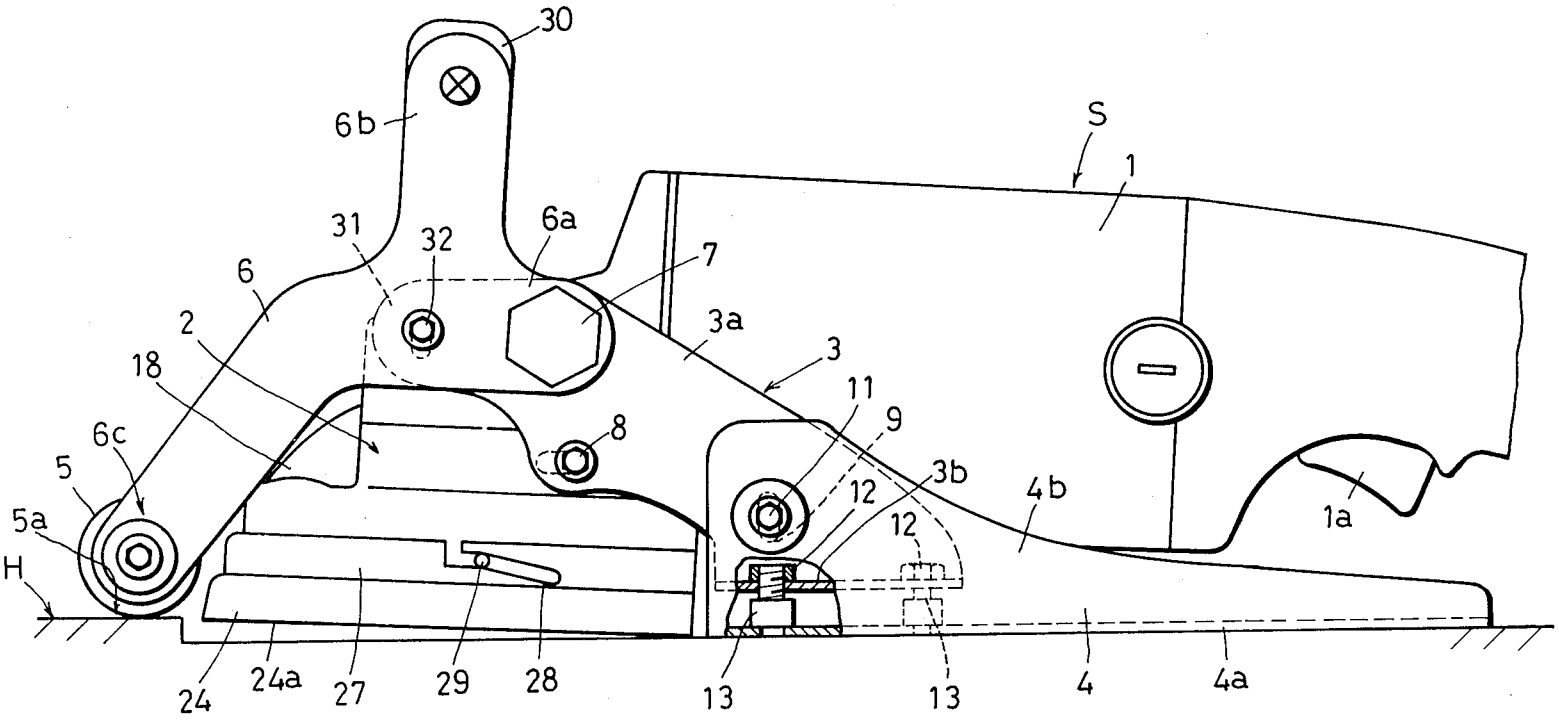
FIG. 8 is a side elevational view illustrating an advantageous use of the power cutting tool in a different operating position.

The base 4 can be tilted due to rotation around the support bolt 7 by means of the adjusting bolt 8 through the base holder 3, as illustrated in FIG. 8, in which the cutting tool is advantageously used to cut the different levels on concrete placing. In this figure the base 4 is contacted with the lower level, while the rotary cutter 20 is tilted to proceed cutting of the different levels into bevel from right to left in the figure. Of course the base 4 can be rotated clockwise in the opposite direction through the base holder 3. The direction of rotation will be determined according to the cutting conditions.

When the tip 22 of the rotary cutter 20 is worn, which causes an elevational difference between the lower surface of the rotary cutter 20 and that of the base 4, adjustment is carried out by threading all of the bolts 13 upwardly for a required distance. Then each adjusting bolt 11 is loosened to release the base 4 from the base holder 3. Once the base 4 has been moved upwardly to set the lower surface thereof substantially on the same level as that of the rotary cutter 20, each adjusting bolt 11 is fastened and each bolt 13 is threaded a little downwardly. Now the base 4 is fixed in the same way as the first. After the power cutting tool is set wholly onto the workpiece surface H, the opening lowermost edge 24*a* of the cover body 24 being tightly contacted with the workpiece surface H, the rotary cutter 20 is started. While the cutting proceeds, the workpiece surface H is kept in a sealed condition by the cover body 24.

Cutting chips in the inside chamber 26*a* are blown away by suction air flow induced by rotation of the fan 17 through the communicating ports 23 into the outside chamber 26*b*, and enter the fan chamber 19 through the duct port 25*a*, while cutting chips in the outside chamber 26*b* flow through the duct port 25*a* into the fan chamber 19, from whence the both cutting chips which join in the fan chamber 19 are exhausted outside through the exhaust duct 18.

It is particularly advantageous that the cutting chips in the inside chamber 26*a* of the cutting chamber 26 swirlingly flow out through the communicating ports 23 of the rotating rotary cutter 20 to the outside chamber 26*b* and then to the fan chamber 19, which ensures complete discharge of the cutting chips out of the cutting chamber 26 with no remainder as well as prevents the chips from scattering around.

As is mentioned above, the rotary cutter 20 has a plurality of communicating ports 23 so as to keep the rotational balance thereof, and it will be desirable to position the communicating ports 23 in the utmost vicinity of the lowermost end 20*a* to avoid any retaining of the cutting chips in the inside chamber 26*a* of the cutting chamber 26.

As the opening lower edge 24*a* of the cover body 24 is vertically movable through the retaining ring 27 which is tiltingly guided by the engaging pin 29, the opening lower edge 24*a* can be kept on the same level as the cutting plane, even if the cutting plane changes as the cutting proceeds. Then the opening lower edge 24*a* is tightly contacted with the workpiece surface H by pressing down the retaining ring 27 under the guidance of the engaging pin 29. The workpiece surface H is covered in a sealed condition by the cover body 24, which is also advantageous to prevent the cutting chips from scattering out of the cutting chamber 26.

It will be understood that, when the retaining ring 27 is rotated, the engaging pin 29 can be disengaged from the slit 28 and resultantly the cover body 24 can be easily removed from the housing 2. The power cutting tool with the cover body 24 removed from the housing 2 will be particularly useful to enlarge the cutting range in the corner of the workpiece surface H, as the outside edge of the tip 22 of the rotary cutter 20 approaches the utmost vicinity of the corner, or exquisitely finish the recessed portion of the different levels.

While the invention has been described with reference to a preferred embodiment thereof, it is to be understood that modifications or variations may be easily made without departing from the scope of this invention which is defined by the appended claims.

What is claimed is:

1. In a power cutting tool having a drive motor, a housing mechanically connected to the front end of said drive motor, a vertical spindle rotatably supported by and within said housing, said spindle being rotated by said drive motor, a rotary cutter fixed at the lower end of said spindle and adapted to cut a work surface, and a substantially cylindrical cover mounted to said housing and adjustable for the vertical position thereof, said cover encircling said rotary cutter, the improvement comprising:

(a) a plate-like base holder having a forward end pivotally connected to both sides of said housing for angular adjustment relative to said housing and having on the rear portion thereof a bottom slidable on the work surface;

(b) a plate-like roll holder having at the front end thereof a guide roller effective to roll on the work surface and having a rear end pivotally connected to both sides of said housing for angular adjustment relative to said housing; and (c) a fan mounted to said spindle above said rotary cutter and within said housing.

2. The power cutting tool as defined in claim 1 wherein said base holder and said roll holder are mounted to a single shaft projecting symmetrically outwardly from both sides of said housing.

3. The power cutting tool as defined in claim 2 wherein said base holder has a longitudinal slot disposed generally below said shaft, and wherein said housing has an adjusting bolt threadably secured thereto and extending through said slot in said base holder.

4. The power cutting tool as defined in claim 2 wherein said roll holder has a vertical slot disposed generally in the front of said shaft, and wherein said housing has an adjusting bolt threadably secured thereto and extending through said slot in said roll holder.

5. The power cutting tool as defined in claim 1 wherein said base holder has a bottom portion and a pair of opposed wall portions to form a generally U-shaped configuration in cross section.

6. The power cutting tool as defined in claim 5 including a base disposed outside said base holder and having a bottom portion and a pair of opposed wall portions, said bottom portion being so positioned as to provide a clearance against said bottom portion of said base holder, and further including means provided between both of said pair of wall portions on said base and said base holder for permitting vertical movement of said base relative to said base holder.

7. The power cutting tool as defined in claim 6 further including means positioned between said bottom portions of said base and said base holder for permitting fine vertical movement of said base relative to said base holder.

8. The power cutting tool as defined in claim 6 wherein said means for permitting vertical movement of said base relative to said base holder comprises a vertical slot formed in said wall portion of said base and an adjusting bolt mounted to said base holder and extending through said slot on said base.

9. The power cutting tool as defined in claim 7 wherein said means for permitting fine vertical movement of said base relative to said base holder comprises a plurality of adjusting bolts mounted to the respective bottom portions of said base and said base holder.

* * * * *